US007833131B2

(12) United States Patent
Rote

(10) Patent No.: US 7,833,131 B2
(45) Date of Patent: Nov. 16, 2010

(54) REBOUNDER EXERCISE SYSTEM

(76) Inventor: James E. Rote, 29500 Heathercliff Rd., #165, Malibu, CA (US) 90265

( * ) Notice: Subject to any disclaimer, the term of this patent is extended or adjusted under 35 U.S.C. 154(b) by 1249 days.

(21) Appl. No.: 11/098,973

(22) Filed: Apr. 4, 2005

(65) Prior Publication Data

US 2006/0223676 A1 Oct. 5, 2006

(51) Int. Cl.
*A63B 21/00* (2006.01)

(52) U.S. Cl. ..... 482/27; 482/28

(58) Field of Classification Search ..... 482/27–29; 182/139; 5/710

See application file for complete search history.

(56) References Cited

U.S. PATENT DOCUMENTS 4,477,070 A * 10/1984 Appelbaum ..... 482/28
4,598,905 A * 7/1986 Vrana ..... 482/27
5,542,894 A * 8/1996 Jordan ..... 482/83
6,162,061 A * 12/2000 Taylor ..... 434/253
2003/0216220 A1 * 11/2003 Rota ..... 482/27

* cited by examiner

*Primary Examiner*—Jerome Donnelly
(74) *Attorney, Agent, or Firm*—Leon D. Rosen

(57) ABSTRACT

An exerciser includes a small trampoline, or rebounder (12), and a hand support (16) with handles (24, 26) that a person can grasp while jumping and rebounding to stabilize himself or herself, which is suitable for use in a commercial or public workout facility where there are likely to be many rebounders dedicated to such rebound exercising. The hand support lies immediately forward of the front end (46) of a rebounder that rests on a floor. The hand support includes a frame (40) that rests on the floor immediately forward of the rebounder front end and that has a top bar (44) that lies at least one meter above the rebounder mat (18). The top bar pivotally supports a handle device (22) that includes the handles (24, 26) at its lower end that can be grasped by a person who is jumping on the rebounder. The frame can be constructed with a plurality of top bars, all of the same length and forming the sides of a polygon, and a rebounder lies with its front end immediately rearward of each of a plurality of the top bars.

6 Claims, 4 Drawing Sheets

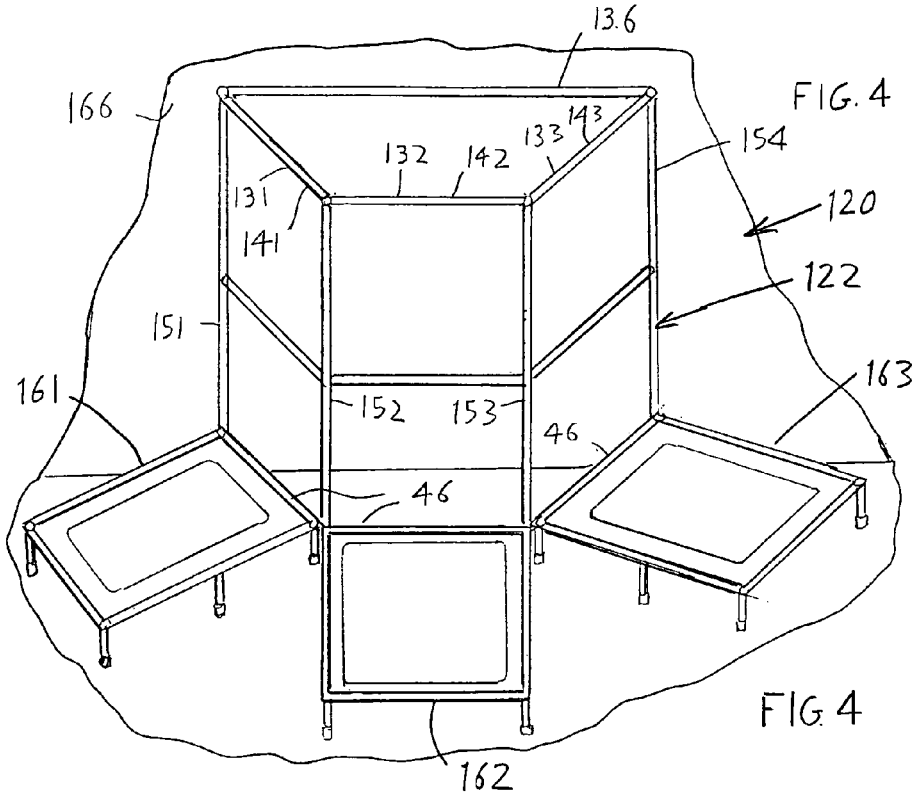
FIG. 4
FIG. 4
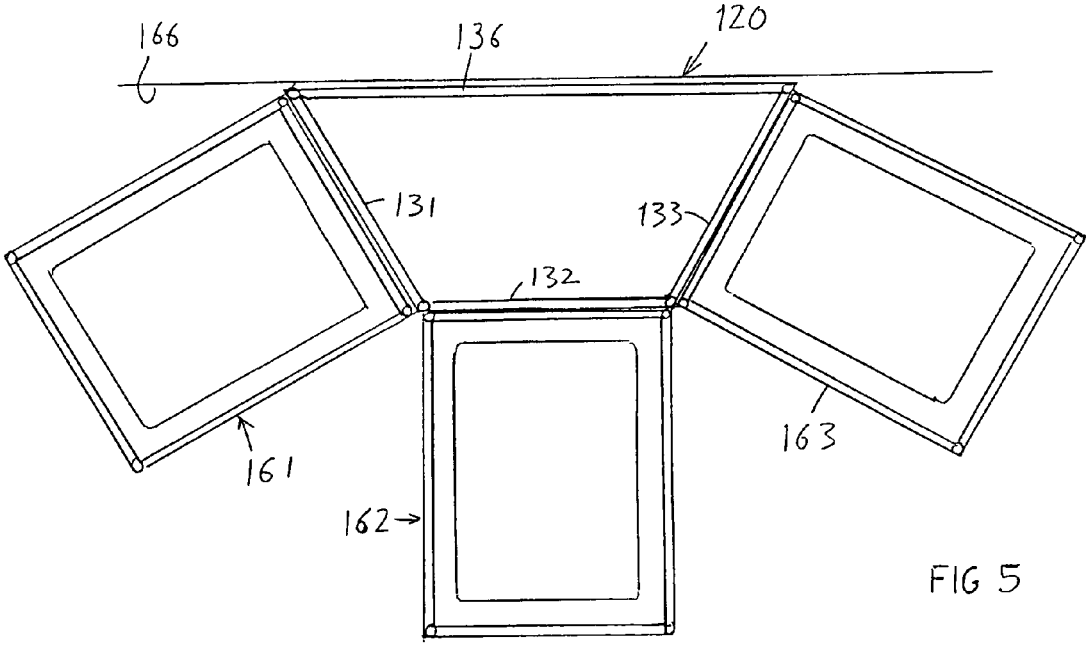
FIG 5

REBOUNDER EXERCISE SYSTEM

BACKGROUND OF THE INVENTION

Rebounding, which is the repeated jumping on a rebounder that is similar to a small trampoline, has been found to be a highly beneficial exercise especially for middle-aged and older persons. My U.S. Pat. No. 6,652,419, which is incorporated by reference herein, describes a conditioning system that is useful in the home, which includes a hand support that is mounted in a home, across a doorway, when the apparatus is to be used, and which is removed and stored away after use. It would be desirable if a similar conditioning system were available, that was set up permanently for use in dedicated exercise establishments wherein many people exercise at the same time. It also would be desirable if such a system allowed a plurality of people each exercising on a rebounder with arm support, to easily communicate with one another to enhance the exercise experience.

SUMMARY OF THE INVENTION

In accordance with one embodiment of the invention, exercisers are provided that are suitable for placement in a dedicated exercise facility, that are always ready for use to perform rebounding exercises, that take up minimum space, and that can be constructed to allow a plurality of persons to perform rebound exercising in close proximity to one another. The exerciser includes a rebounder that comprises a framework that has legs that rest on a floor and that supports edge portions of a mat through multiple springs. The exerciser also includes a hand support that has handles that can be held by a person while jumping on the rebounder. The hand support includes a frame that rests on the floor immediately forward of the front end of the rebounder and that has a top bar that lies at least a meter above the mat and that pivotally supports a hanger device with handles for grasping by an exercising person. The bottom of the frame may be fixed to the framework of the rebounder.

The frame can be in the form of a polygon, as seen in a top view, with a top bar extending along each of a plurality of sides of the polygon. A plurality of rebounders are provided, that each have front ends that lie substantially under one of the top bars. A plurality of persons can each exercise by jumping on one of the rebounders while holding handles of a hanger assembly that extends from a different one of the top bars. The persons are close together so that they can talk to one another without interfering with the exercise of each other. The apparatus which can accommodate a plurality of people at the same time, takes up a minimum of space in the facility.

The novel features of the invention are set forth with particularity in the appended claims. The invention will be best understood from the following description when read in conjunction with the accompanying drawings.

BRIEF DESCRIPTION OF THE DRAWINGS

FIG. 4 is an isometric view of an exerciser of another embodiment of the invention, with the frame having the shape of a polygon with a plurality of sides of equal lengths, shown without the handle devices and installed in a room.

FIG. 5 is a plan view of the exerciser of FIG. 4.

DESCRIPTION OF THE PREFERRED EMBODIMENT

Figure 1:
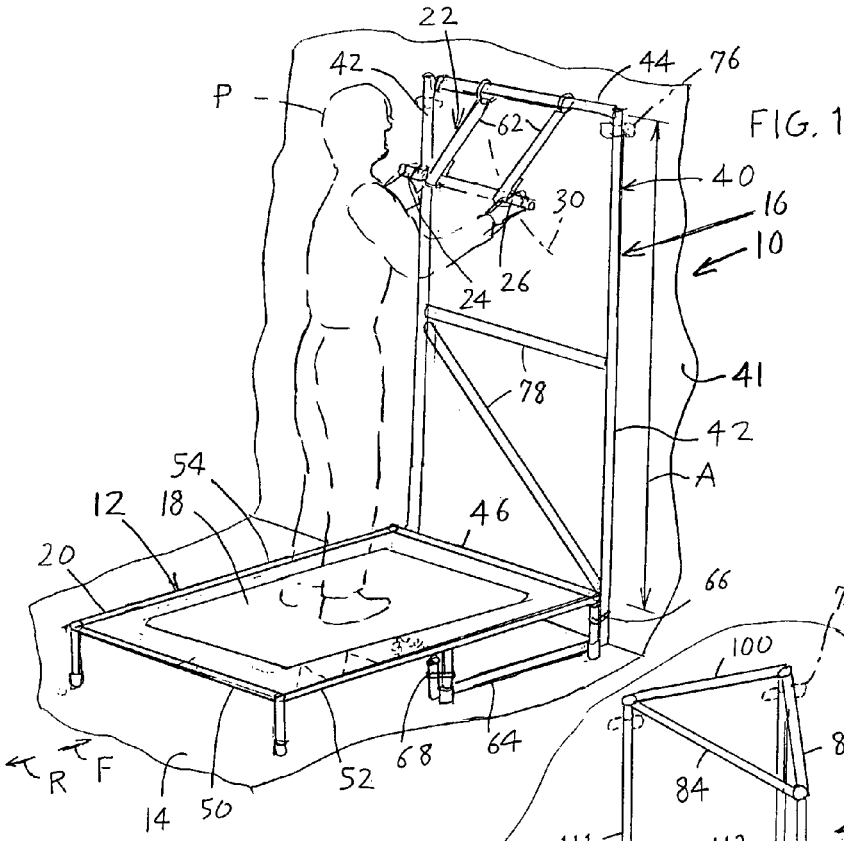
FIG. 1 is a rear isometric view of an exerciser of the present invention, showing it being used by a person in a room.

FIG. 1 shows an exerciser 10 of the present invention, which includes a rebounder 12 lying on a floor 14 of a room, and a hand support assembly 16, and showing a person P using the exerciser. The person uses the exerciser by repeatedly jumping or bouncing on a mat 18 of the rebounder. Many people do not feel safe jumping on the rebounder, especially since the mat is of small size (e.g. 24×36 inches), because they are afraid that they will land on the steel framework 20 that surrounds the mat and/or will tilt sideways and fall onto the framework or floor. A handle device in the form of a hanger assembly 22 of the hand support assembly 16 gives the person confidence that he/she will be able to remain in the center of the mat and will not tilt to one side, or will know when he/she is deviating from the correct position and orientation without having to constantly look down. The hand support assembly 16 also provides variation in muscle exercise.

My earlier U.S. Pat. No. 6,652,419 describes several different types of handle devices, each of which has a pair of handles 24, 26 that move up and down with the exercising person along predefined paths 30 that are arcs of a circle. However, my earlier patent describes an exerciser for home use, with a handle device mounted in a doorway and moved after each use. Applicant finds that his type of exerciser has use in dedicated exercise facilities where numerous people come in and wish to immediately begin exercising without having to set up the device.

In accordance with one embodiment of the invention, applicant provides the exercise device of FIG. 1 wherein the hand support assembly 16 includes a frame 40. The frame rests on the floor 14 and/or is attached to a wall of a room such as a primarily vertical wall 41 or a floor or ceiling. The frame supports the handle device 22 for grasping by a person who is jumping on the rebounder. The frame 40 includes a plurality of primarily vertical column bars (in the form of tubes), or structural bars 42, that have lower ends lying at the level of the floor and that support a horizontal top bar 44 at a height A of at least one meter above the mat 18. The rebounder is of generally rectangular shape, with front and rear ends 46, 50 and opposite sides 52, 54. The exercising person faces forwardly F and grasps the handles 24, 26 of the handle device 22. The handles lie at the bottom of hanger elements 62 whose upper ends are pivotally mounted on the top bar 44.

It is desirable that the top bar 44 lie horizontally within 12 inches, and preferably within 6 inches of the front end 46 of the rebounder, as seen in a top view, so a person standing on the mat can easily grasp the handles 24, 26 and hold them while jumping. It is preferable to attach the frame 40 to the rebounder if the frame is not fixed to a wall or floor. The rebounder does not shift position in use. FIG. 1 shows a frame lower beam 64 that lies on or close (within an inch) to the floor and that is connected by ties 66, 68 to the rebounder framework 20, as to its legs. The frame 40 can be fixed to the wall 74 of the room, as by brackets 76 (or to the floor or ceiling). Bracing bars 78 are shown.

Figure 2:
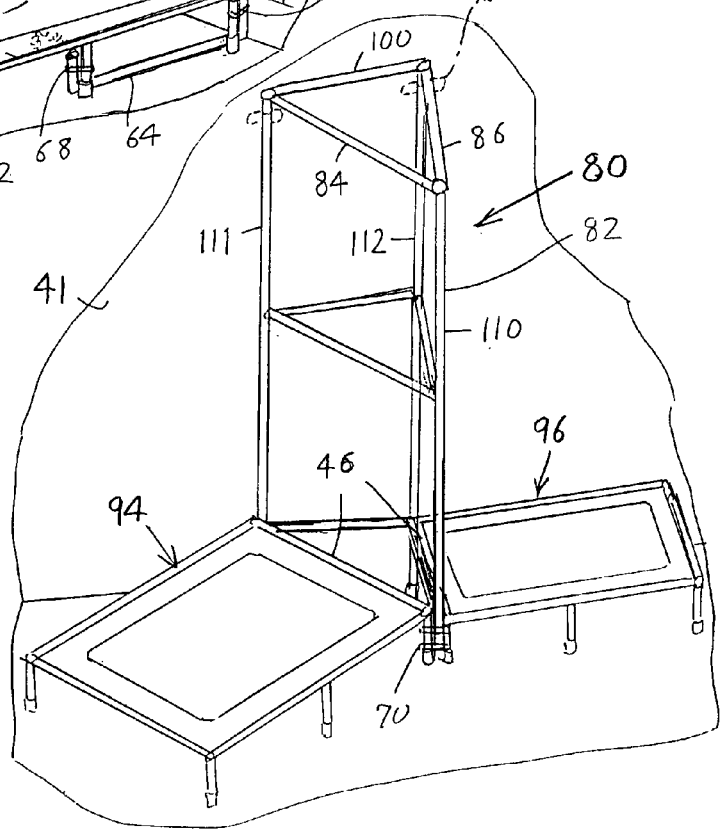
FIG. 2 is an isometric view of an exerciser of another embodiment of the invention shown installed in a room, with the frame having the shape of an isosceles triangle, shown without handle devices.
Figure 3:
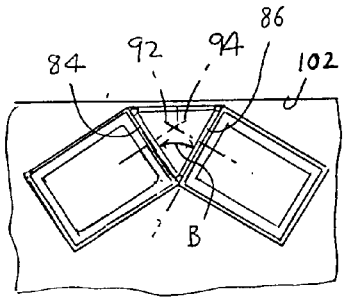
FIG. 3 is a plan view of the exerciser of FIG. 2.

Applicant's exerciser, which includes a rebounder and a hand support assembly, can be constructed so a group of persons can perform jumping exercises at the same time and remain close together so they can converse if they wish to. FIGS. 2 and 3 show an exerciser 80 with a frame 82 in the form of an isosceles triangle with two top bars 84, 86 forming two triangle sides of the same length. Actually, the particular triangle has all three sides of the same length. One side 100 can lie against and be attached to the wall 102 of the establishment, or a part can be attached to the floor by a bracing system. A pair of rebounders 94, 96 are positioned with their front ends 46 lying almost directly under the top bars 84, 86. Two people can use the exerciser at the same time. The two people can readily see each other to converse if they wish, but their forward views 92, 94 (FIG. 3) are angled about 60° from each other so they do not constantly look at each other. The frame has three primarily vertical column bars 110-112 lying at the corners of the equilateral triangle. FIG. 3 shows that there is an acute angle B between adjacent top bars. The frame 82 can be tied to the rebounder by ties 70, and/or can be held to the wall 41 as by bracket 76. Handle devices of the type shown at 22 in FIG. 1 are hung from each top bar.

FIGS. 4 and 5 illustrate an exerciser 120 with a frame 122 in the form of a polygon, as seen in a plan, or top view, with a plurality of sides 131-133 of the same length and with an additional side 136 of different length. The frame includes a plurality of top bars 141-143 extending along the sides 131-133 and has a plurality of primarily vertical column bars, or structural bars, 151-154 with pairs of the column bars lying at opposite sides of the top bars 141-143. The exerciser includes a plurality of rebounders 161-163 each of the type illustrated in FIG. 1, with front ends 46 each lying almost directly (within 12 inches and preferably 6 inches) under a corresponding one of the top bars 141-143. The three top bars and three rebounders allow three people to exercise and remain close together but with their straight-ahead views angled by many degrees (preferable at least 30°) from each other. The additional side 136 can lie against and possibly be fixed to a wall 166 to take up a minimum of space in the facility. The frame 122 can be fixed to the rebounders and/or attached to the wall, floor or ceiling. A handle device (22, FIG. 1) is hung from each top bar.

Figure 6:
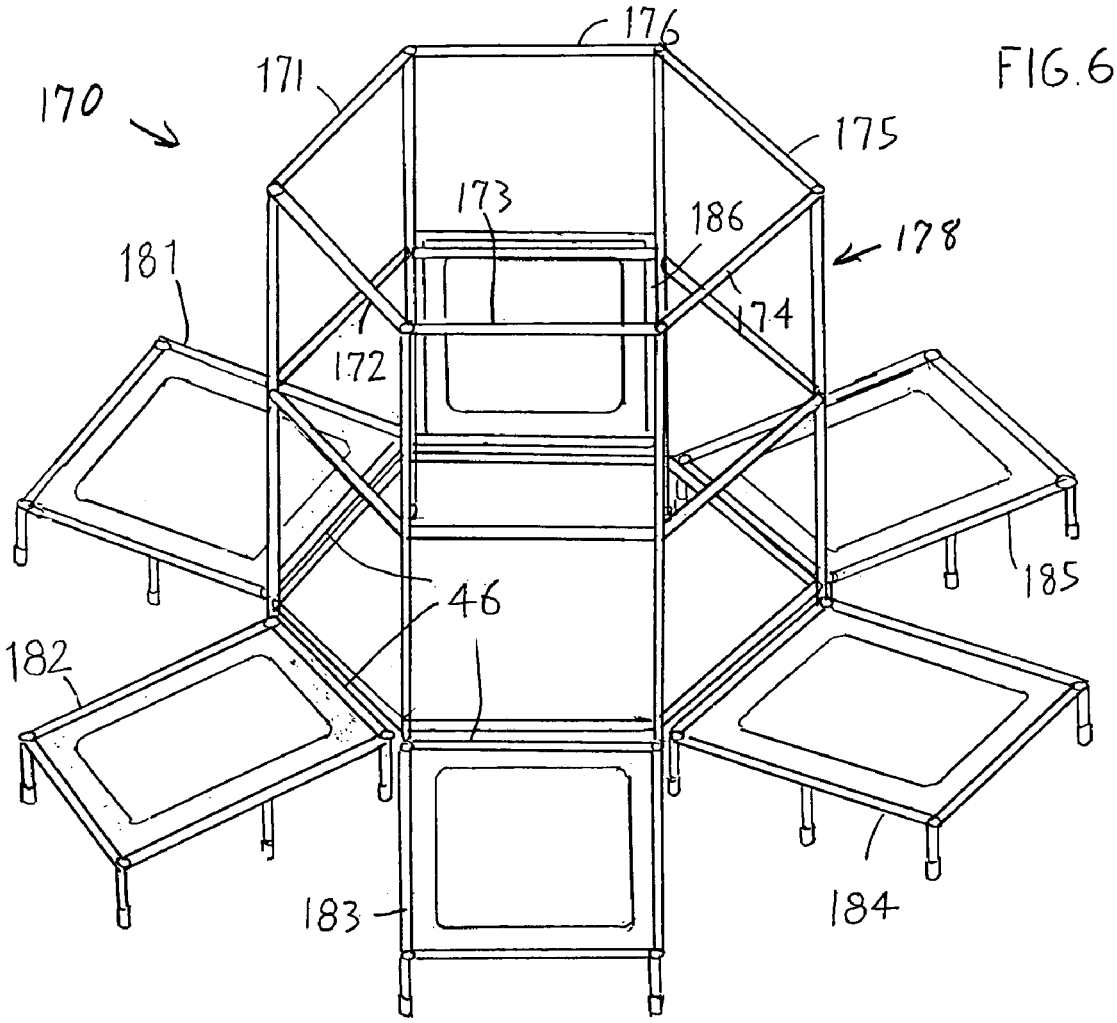
FIG. 6 is an isometric view of an exerciser of another embodiment of the invention, with the frame having the shape of a hexagon, shown without the handle devices.
Figure 7:
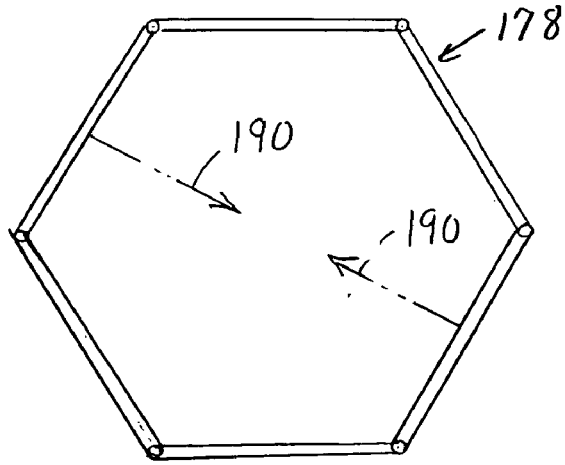
FIG. 7 is a plan view of the frame of the exerciser of FIG. 6.

FIG. 6 illustrates an exerciser 170 with a frame 178 in the form of a regular polygon, and specifically a hexagon, as seen in a top view. The frame has six top bars 171-176 each extending along one side of the hexagon. The exerciser includes six rebounders 181-186 that are each of the type illustrated in FIG. 1, with front ends 46 each lying almost directly under a corresponding one of the six top bars. The six rebounders allow six people to exercise at the same time. As shown in FIG. 7, the front views 190 of opposite persons are directed at each other, but those persons (who stand near the middle of their mats) are spaced apart by more than twice the length of each top bar. The exerciser is designed to stand away from any wall. Bracing bars are not shown, and handle devices (22, FIG. 1) are not shown.

Figure 8:
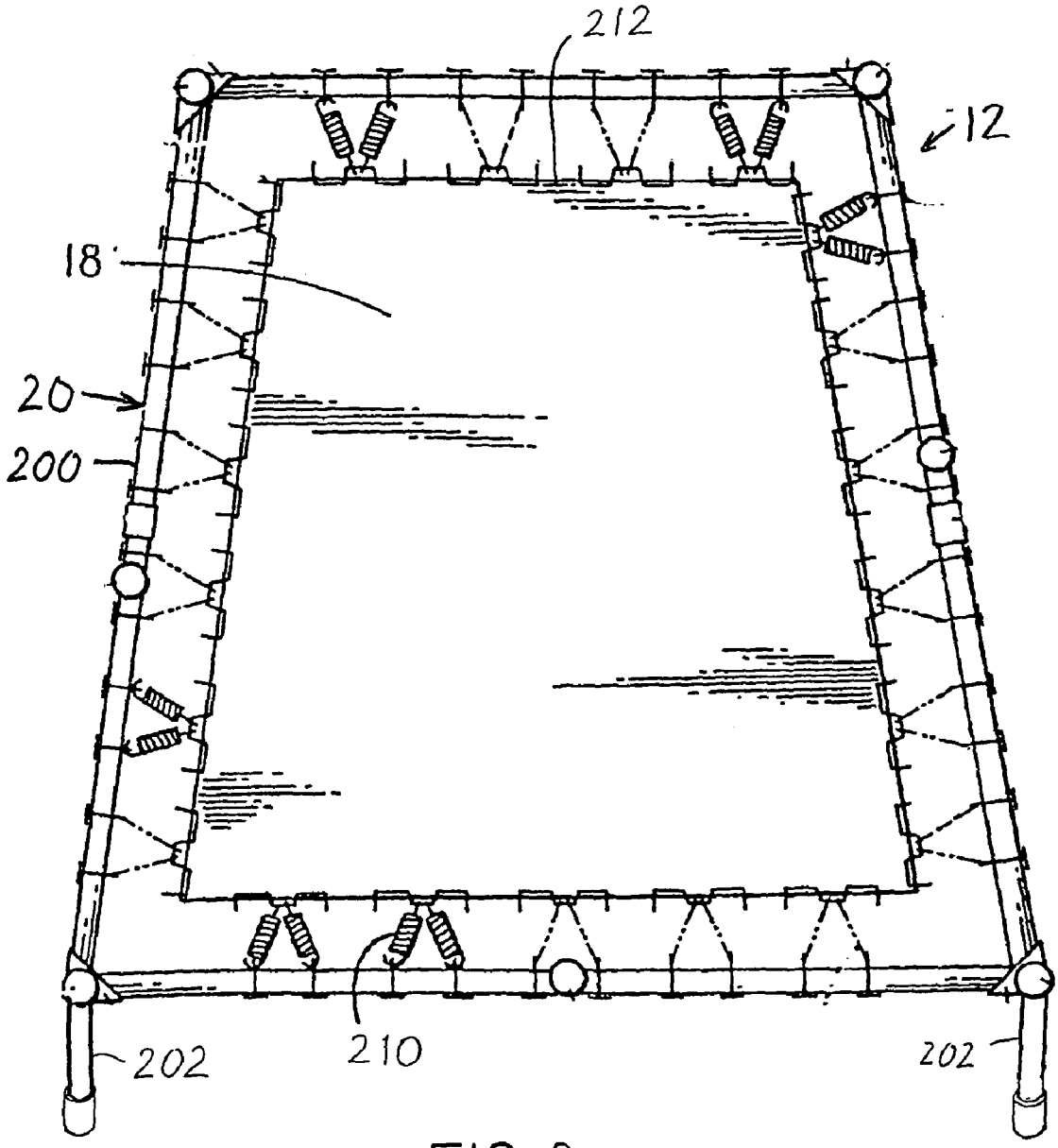
FIG. 8 is an isometric view of a rebounder of the exercisers of FIGS. 1-7.

FIG. 8 shows one construction of one of the rebounders. The rebounder framework 20 includes a mat-surrounding portion 200 and a plurality of legs 202 that support the mat-surrounding portion about six inches above the floor. A multiplicity of springs 210 connect the surrounding portion to a peripheral portion of the mat 18. The mat is of generally rectangular shape with its front end 212 extending parallel to a front end of the framework. Instead of springs, it is possible to use elastic (e.g. rubber) material or other elastic means to couple the mat edges to the surrounding portion.

Thus, the invention provides an exerciser that includes at least one rebounder and at least one hand support assembly that provides handles that can be grasped by persons jumping on the rebounder, which is suitable for use in an exercising facility where each hand support assembly is always ready to use. In one exerciser, the hand support assembly includes a thin frame with a single top bar and with a lower end fixed to the rebounder framework or to a wall, and that is suitable to lie adjacent to a wall of the exerciser room. Other exercisers include a frame that has a plurality of top bars from which each of a plurality of hand supports can be hung, and with a rebounder lying with its front end under each top bar. The frame can be attached to the rebounder or to a room wall, or can be freestanding.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. Apparatus for enabling people to exercise in a facility with a floor, comprising:

a frame in the form of a polygon as seen in a plan view, with a plurality of horizontal arm-support top bars each of the same length and extending along a plurality of the sides of the polygon and a plurality of structural bars that have lower ends lying at the level of the floor;

a plurality of handle devices, each hung from a different one of said top bars and each forming a pair of handles that move in an arc;

a plurality of rebounders that each includes a flexible mat with edge portions, a mat, a framework with a plurality of legs for resting on a floor and a mat-surrounding framework part, and elastic means that supports said mat edge portions on said mat-surrounding framework part, said rebounder having a front;

the front of each rebounder framework extending parallel to and lying substantially under one of said arm-support top bars of said frame.

2. The apparatus described in claim 1 wherein:

said frame has a plurality of structural bars including vertical column bar portions, said rebounder legs includes a pairs of legs spaced apart by about the same as the spacing of a pair of said vertical column bar portions, and said rebounder legs are fixed to lower ends of said structural bars.

3. The apparatus described in claim 1 wherein:

said polygon has all sides of the same length and said top bars are each of the same length and extend along each side of the polygon;

said plurality of rebounders includes a plurality of rebounders each with a front end lying substantially under one of said sides of said polygon.

4. Exercise apparatus comprising:

a rebounder that includes a flexible mat with edge portions, and a rebounder framework forming legs with lower leg ends for resting on a floor and upper ends and with the framework forming a mat-surrounding framework portion, and elastic means that supports said mat edge portions on said mat-surrounding portion, to rebound a person who jumps on the mat, said rebounder having a rebounder front end;

a hand support assembly for use by the person who jumps on the mat, which includes a frame with a hand support portion that lies over a position adjacent to said rebounder front end;

said hand support assembly also including a handle device mounted on said frame and having a pair of handles that are grippable by the person's hands, to enable the person to steady himself or herself while jumping on and rebounding from the mat;

said frame having a lower portion that is fixed in position with respect to said rebounder;

said rebounder has first and second opposite sides;

said frame upper portion is in the shape of an isosceles triangle as seen in a plan view and includes three primarily vertical column bars at the corners of the triangle and also includes three horizontal top bars that join the column bars, said handle device including a pair of hanger elements with upper ends pivotally mounted on one of said top bars and at least one lower element that forms said handles; and including a second rebounder device that is substantially identical to said rebounder, said second rebounder device having a front end lying under said second top bar member, and including a second handle device assembly that is substantially identical to said handle device and that includes hanger elements hung from said second bar.

5. Exercise apparatus comprising:

a rebounder that includes a flexible mat with edge portions, and a rebounder framework forming legs with lower leg ends for resting on a floor and upper ends and with the framework forming a mat-surrounding framework portion, and elastic means that supports said mat edge portions on said mat-surrounding portion, to rebound a person who jumps on the mat, said rebounder having a rebounder front end;

a hand support assembly for use by the person who jumps on the mat, which includes a frame with a hand support portion that lies over a position adjacent to said rebounder front end;

said hand support assembly also including a handle device mounted on said frame and having a pair of handles that are grippable by the person's hands, to enable the person to steady himself or herself while jumping on and rebounding from the mat;

said frame having a lower portion that is fixed in position with respect to said rebounder;

said frame has a plurality of top bars that each forms a side of a polygon and that are joined to form said polygon; and including at least one additional rebounder device that is of the same construction as said rebounder and that has a rebounder device front that lies adjacent to a location under another of said top bars;

at least one additional handle device assembly that is hung from one of said top bars and that has a pair of handles.

6. The apparatus described in claim 5 wherein:

said polygon has at least three sides angled apart at angles no greater than right angles, and includes a top bar element at least two of said sides and at least two rebounder devices each having a front end lying under one of said top bar elements.

* * * * *